US010401797B2

(12) United States Patent
Mace

(10) Patent No.: US 10,401,797 B2
(45) Date of Patent: Sep. 3, 2019

(54) DEVICE FOR IMMOBILISING AND/OR WINDING A MARINE CHRONOMETER

(71) Applicant: Montres Breguet S.A., L'Abbaye (CH)

(72) Inventor: Jerome Mace, Le Pont (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/730,900

(22) Filed: Oct. 12, 2017

(65) Prior Publication Data

US 2018/0120772 A1 May 3, 2018

(30) Foreign Application Priority Data

Nov. 2, 2016 (EP) ..... 16196926

(51) Int. Cl.

| | |
|---|---|
| ***G04B 3/02*** | (2006.01) |
| ***G04B 37/14*** | (2006.01) |
| ***G04B 41/00*** | (2006.01) |
| *G04B 17/28* | (2006.01) |

(52) U.S. Cl.

CPC ..... *G04B 37/1426* (2013.01); *G04B 3/02* (2013.01); *G04B 41/00* (2013.01); *G04B 17/28* (2013.01)

(58) Field of Classification Search

CPC . G04B 5/00; G04B 41/00; G04B 3/02; G04B 17/28; G04B 37/1426

See application file for complete search history.

(56) References Cited

U.S. PATENT DOCUMENTS

| | | | | |
|---|---|---|---|---|
| 227,972 | A | 5/1880 | Gareis | |
| 2,425,602 | A | 8/1947 | Drescher | |
| 3,191,901 | A * | 6/1965 | Green | A47G 29/08 248/116 |
| D388,001 | S * | 12/1997 | Wunderman | D10/30 |
| 2003/0146736 | A1* | 8/2003 | Kosuda | G04C 10/00 320/132 |
| 2014/0126338 | A1* | 5/2014 | Forsey | G04B 17/285 368/127 |
| 2016/0004223 | A1* | 1/2016 | Willemin | G04C 1/02 368/207 |
| 2016/0299475 | A1* | 10/2016 | Baba | H04B 5/0081 |
| 2019/0041894 | A1* | 2/2019 | Parazynski | G05G 5/03 |

FOREIGN PATENT DOCUMENTS

| | | |
|---|---|---|
| CH | 2960 | 4/1981 |
| CH | 700 958 A2 | 11/2010 |
| CH | 706 352 A2 | 10/2013 |

OTHER PUBLICATIONS

European Search Report dated May 10, 2017 in European Application 16196926.6, filed on Nov. 2, 2016 (with English Translation of Categories of cited documents).

* cited by examiner

*Primary Examiner* — Sean P Kayes

(74) *Attorney, Agent, or Firm* — Oblon, McClelland, Maier & Neustadt, L.L.P.

(57) ABSTRACT

A marine chronometer including a watch tiltably mounted on a support with a gimbal suspension, the chronometer support also includes a cradle movable in translation between a rest position wherein the watch is free to move on the gimbal suspension, and a holding position wherein the watch is resting on the cradle.

20 Claims, 6 Drawing Sheets

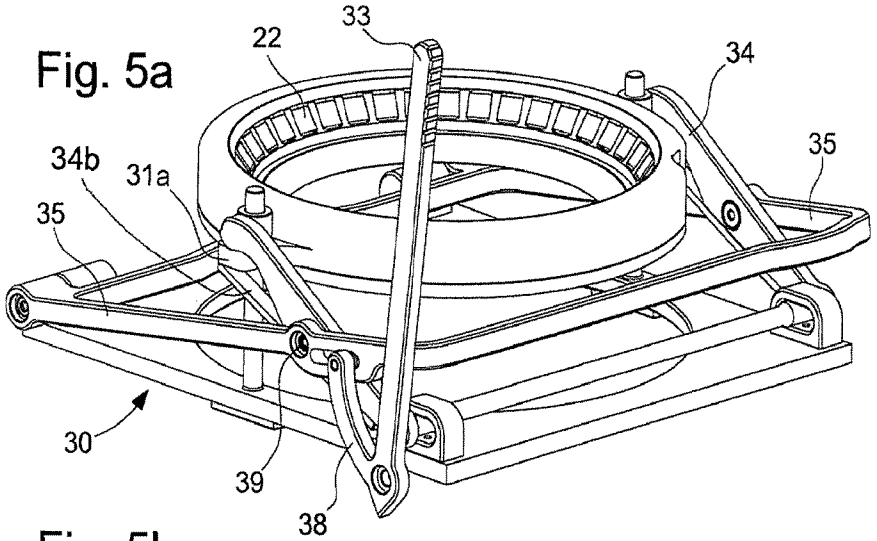
Fig. 5a
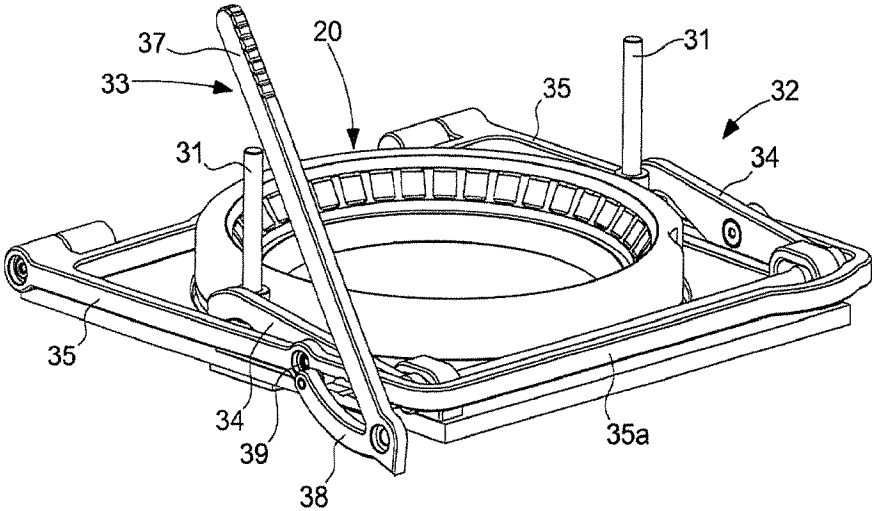
Fig. 5b
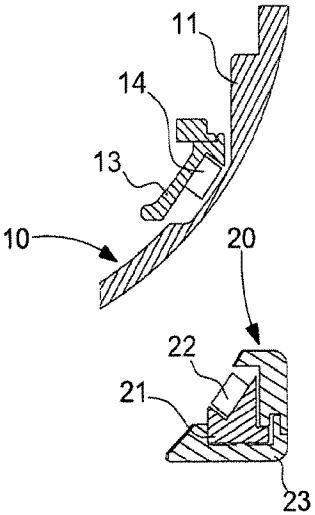
Fig. 5c
Fig. 5d
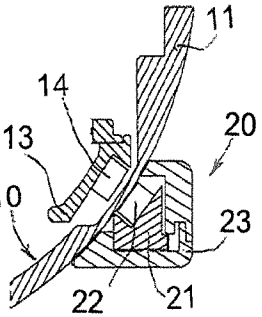
Fig. 5e

DEVICE FOR IMMOBILISING AND/OR WINDING A MARINE CHRONOMETER

This application claims priority from European Patent Application No. 16196926.6 filed on Nov. 2, 2016, the entire disclosure of which is hereby incorporated herein by reference.

FIELD OF THE INVENTION AND STATE OF THE ART

The invention concerns a marine chronometer, comprising a watch, generally a large format watch, designed to keep time on ships. In a known manner, such a watch is fixed to a support by means of a gimbal suspension so that the watch can be tilted in all directions relative to the support. The gimbal suspension thus ensures that the watch, and more precisely the watch dial, remains in a horizontal position, regardless of the motions of the ship. A gimbal suspension is, however, fragile and does not tolerate movements and shocks well, particularly due to the weight of the watch that it carries.

Also, a marine chronometer must be usable in difficult climatic conditions and must, in particular, be water resistant. In a known manner, the watch is equipped with a water-resistant case. However, the water-resistance of the mechanical contact area between the watch mechanism, inside the case, and the winding mechanism, positioned outside the watch case, generally ensured by a sealing gasket, is not always guaranteed in all conditions of use, for example when the time is set, the effectiveness of the sealing gasket may be diminished.

DESCRIPTION OF THE INVENTION

The invention proposes a new marine chronometer that does not have at least one of the drawbacks of the known marine chronometers described above.

To this end, the invention proposes a marine chronometer including a watch tiltably mounted on a support by means of a gimbal suspension, the chronometer being wherein the support also includes a cradle movable in translation between a rest position wherein the watch is free to move on the gimbal suspension, and a holding position wherein the watch is resting on the cradle. In other words, in the rest position, the cradle bears the weight of the watch, thereby relieving the gimbal suspension.

According to one embodiment, the cradle includes magnetic means capable of cooperating with associated magnetic means of the watch to immobilise the watch in the cradle when the cradle is in the holding position.

The cradle may also take an intermediate position between the rest position and the holding position, in which intermediate position the magnetic means of the cradle are adapted to cooperate with the associated magnetic means of the watch to orient the watch, which is initially free to rotate on the gimbal relative to the cradle, before immobilising it in the cradle.

According to one embodiment, the chronometer support according to the invention may include:

- at least one holding arbor on which the cradle is slidably mounted, and
- a scissor-lift type mechanism for sliding the cradle along the holding arbor between the holding position and the rest position.

The lift mechanism is, for example, manually actuated by a lever.

The support may also comprise magnetic insulation means, movable between:

- an insulating position wherein, when the cradle is in the rest position, the insulation means form a magnetic screen between the magnetic means of the cradle and the magnetic means of the watch, and
- a retracted position wherein, when the cradle is in the holding position, the magnetic insulation means are inactive.

The use of magnetic insulation means in the cradle rest position makes it possible to use sufficiently strong magnetic devices to ensure zero or virtually zero coupling when the cradle is in the rest position, without requiring too great a distance between the cradle at rest and the watch. This makes it possible to limit the external dimensions of the chronometer.

According to one embodiment, the watch may include a mechanism for winding the barrel of its timepiece movement and which includes a winding rotor in mesh with a winding train of the conventional mechanical timepiece movement which will not be described in detail. The rotor comprises a plurality of magnetic devices distributed around the external periphery of the rotor to form the magnetic means of the watch which are adapted to cooperate with the magnetic means of the cradle when the cradle is in the holding position or in the intermediate position. The cradle may comprise an annular stator including a plurality of magnetic devices distributed around the inner periphery of the stator to form the magnetic means of the cradle. The stator may be a toothed wheel adapted to mesh with a winding pinion which is disposed outside the watch and independent thereof when the cradle is in the holding position. Thus, in the holding position, the cradle may be used, on the one hand, to immobilise and support the watch, and on the other hand, to wind the watch mechanism.

The invention also concerns a marine chronometer including a watch tiltably mounted on a support by means of a gimbal suspension, which chronometer is wherein the watch includes a mechanical timepiece movement including a winding rotor in mesh with a barrel-winding train of the timepiece movement, and wherein the support comprises a winding means, movable between:

- a winding position wherein the watch rotor is magnetically coupled to the winding means, and
- a rest position wherein the watch rotor is free to rotate with respect to the winding means.

The use of a magnetic coupling for winding the watch-barrel obviates the need for a passage for a winding stem through the watch case and thus makes it possible to achieve a perfectly water-resistant watch case.

Further, winding can advantageously be achieved without having to turn the case over and thus still allows the time to be read during the winding operation.

According to one embodiment, the winding means includes an annular stator comprising a plurality of magnetic devices distributed around an inner periphery of the stator, the stator being movable between the winding position and the rest position, the stator being a toothed wheel adapted to mesh with a winding pinion disposed outside the watch and independent thereof when the stator is in the winding position.

BRIEF DESCRIPTION OF THE DRAWINGS

The invention will be better understood, and other features and advantages of the invention will appear in light of the following description of example embodiments of a chronometer according to the invention. These examples are given by way of non-limiting illustration. The description is to be read with reference to the annexed drawings, in which:

FIGS. 5*a*, 5*b* are views of another element of the chronometer according to the invention.

FIGS. 5*c*, 5*d*, 5*e* are view of partial details showing the operation of a chronometer according to the invention.

DESCRIPTION OF ONE EMBODIMENT OF THE INVENTION

Figure 1:
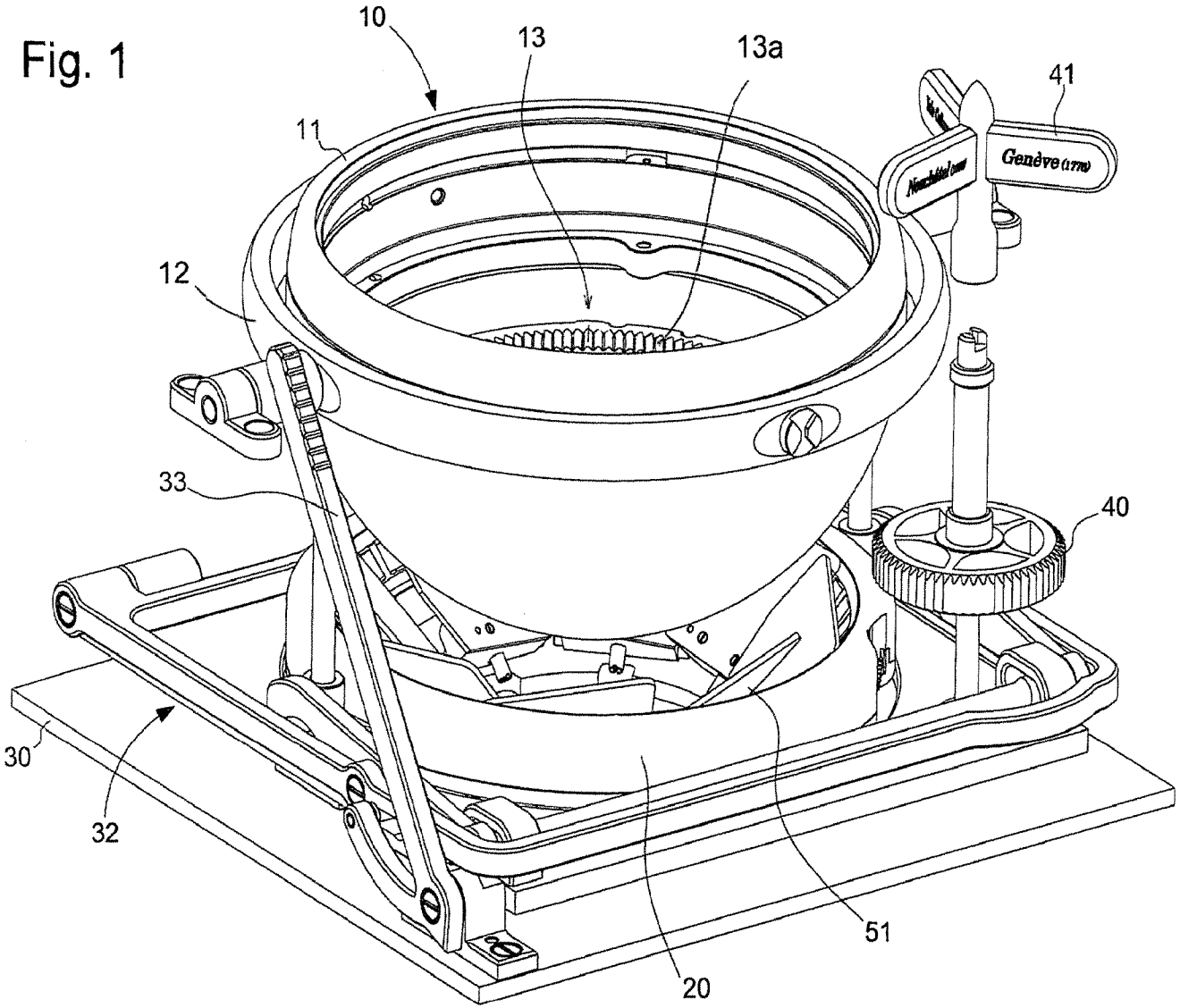
FIG. 1 is a view of the chronometer in the rest position.
Figure 1A:
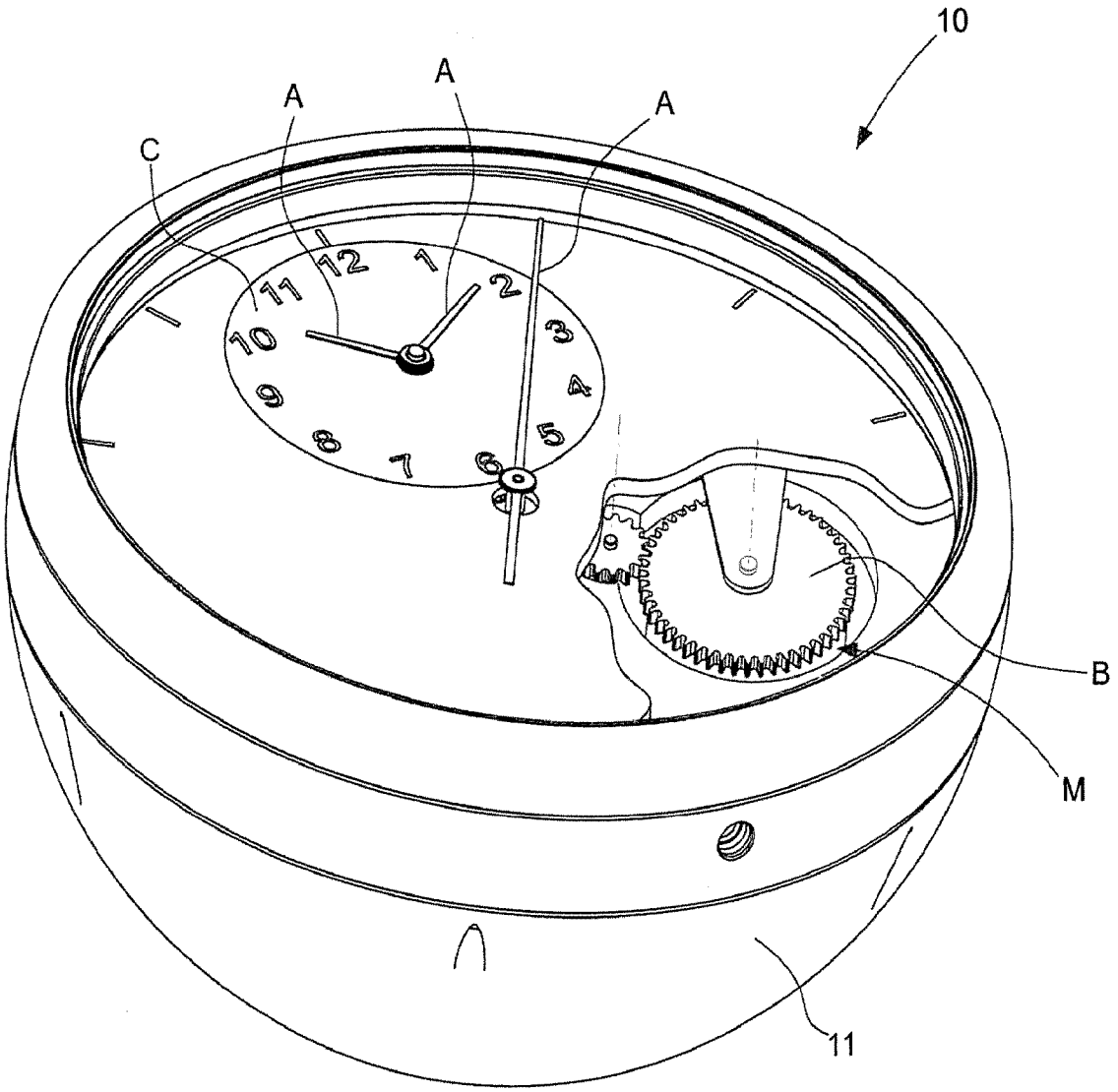
FIG. 1*a* is a perspective view of the chronometer case out of its support structure.

As previously stated, the invention concerns a marine chronometer comprising a watch 10 tiltably mounted on a support 30 by means of a gimbal suspension. In the example represented, watch 10 includes a case 11 in the form of a portion of a sphere, inside which is housed the timepiece movement M of the watch whose drive means are formed by a barrel B. Case 11 is closed in a conventional, water-resistant manner by a crystal, underneath which are positioned the dial C, hands A, and the timepiece movement, as seen in FIG. 1*a*. The gimbal suspension of watch 10, which is known per se, is represented simply by a suspension ring 12; the mechanical connections between ring 12 and support 30 are not represented for clarity of the Figures.

Figure 2B:
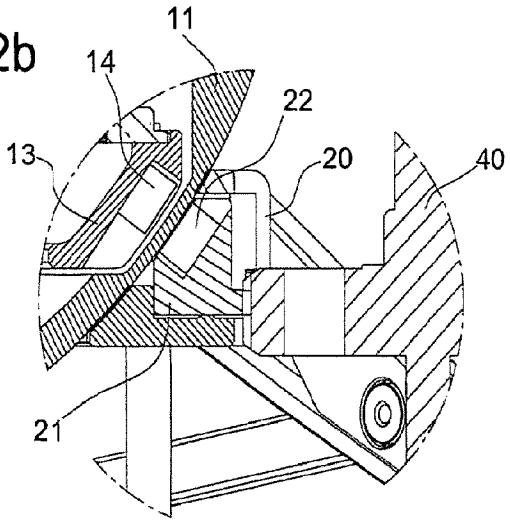
FIGS. 2*b* and 2*c* are views of details of the chronometer of FIG. 2*a*.
Figure 2C:
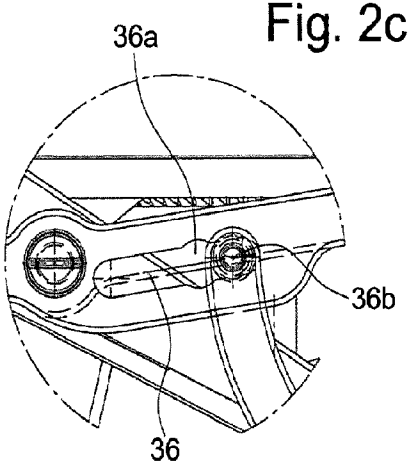
Figure 2A:
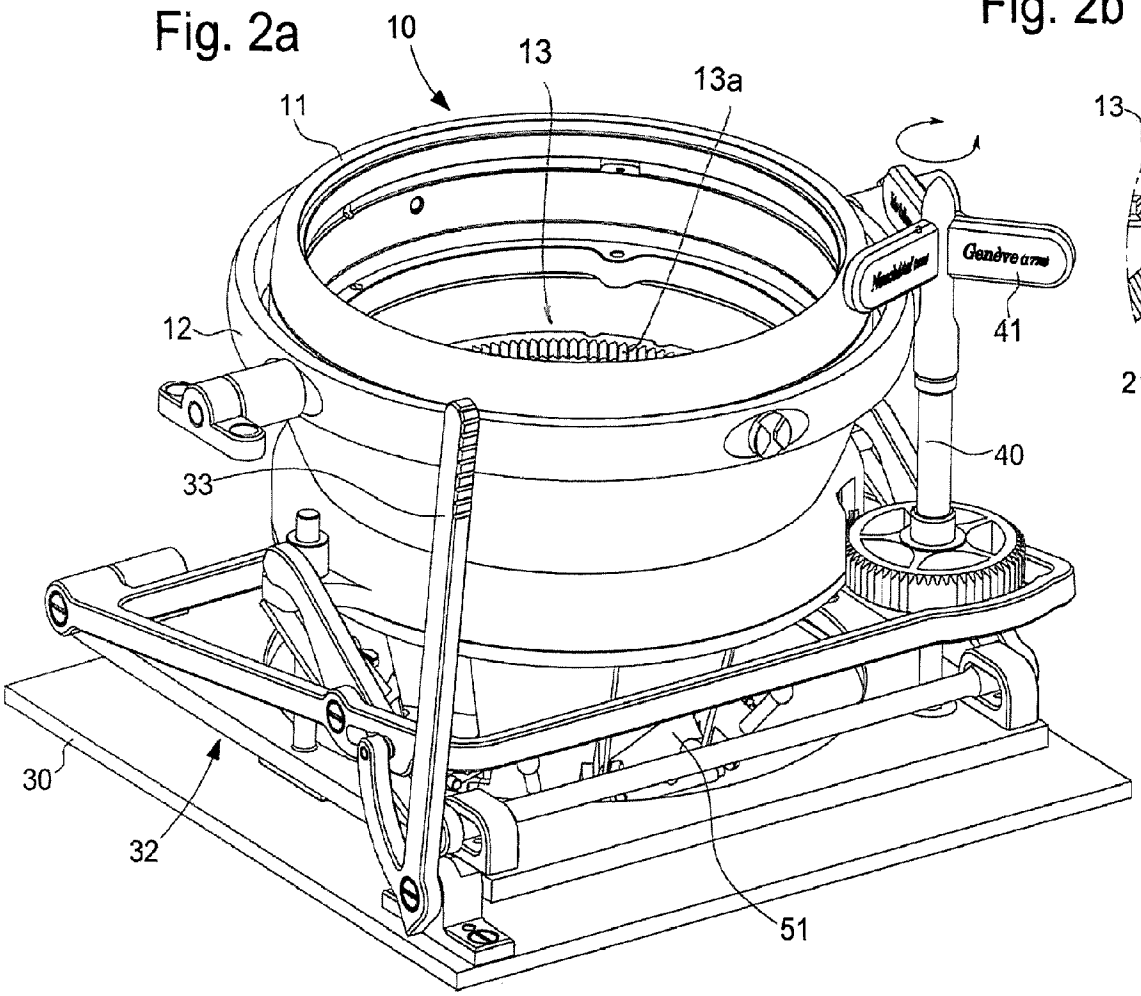
FIG. 2*a* is a view of the chronometer in the holding position.
Figure 3:
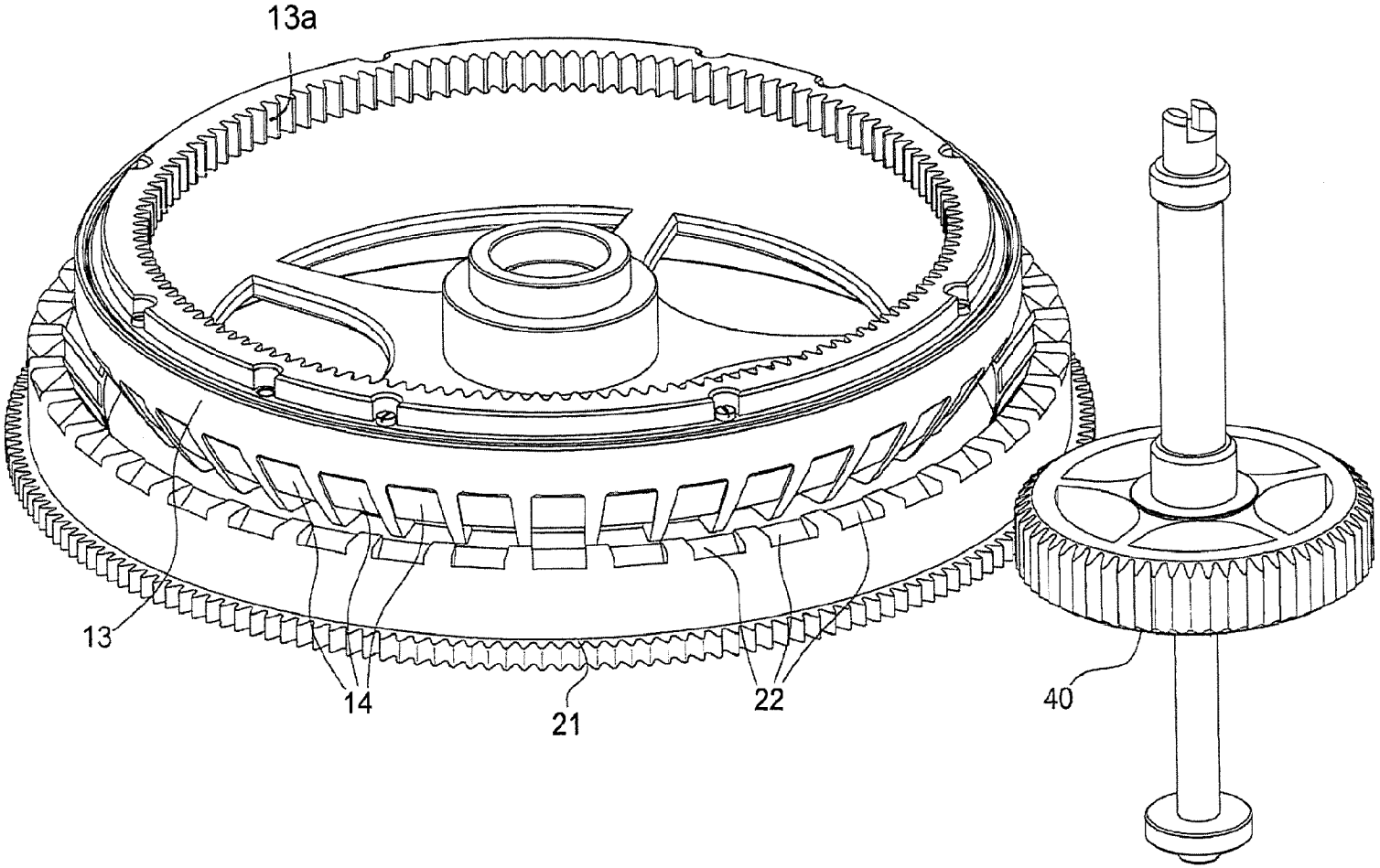
FIG. 3 is a partial view of the magnetic drive mechanism of the chronometer according to the invention.
Figure 4A:
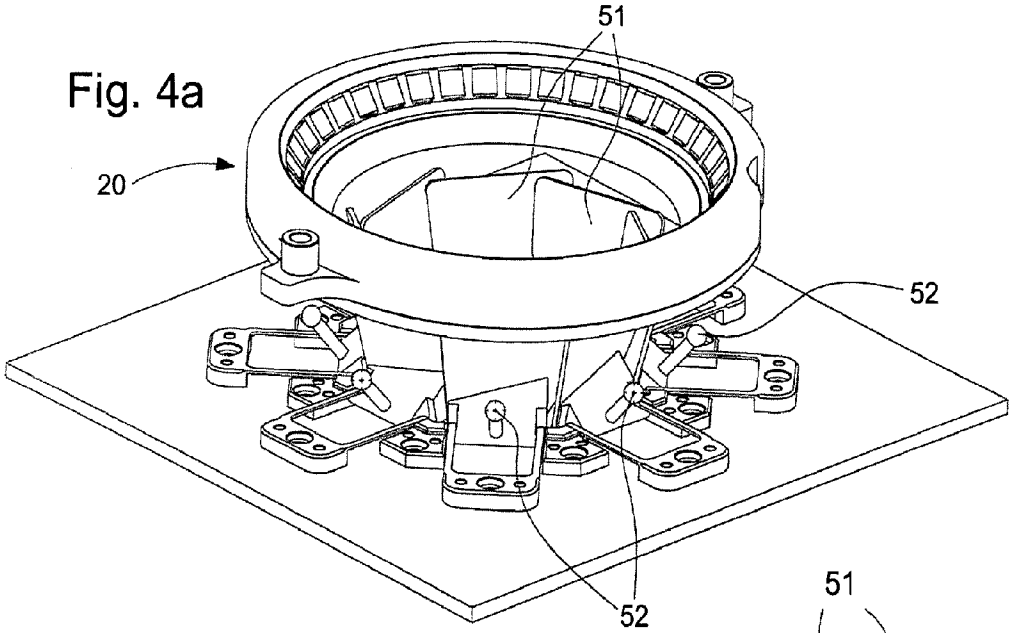
FIGS. 4*a* and 4*b* are views of an essential element of the chronometer according to the invention.
Figure 4B:
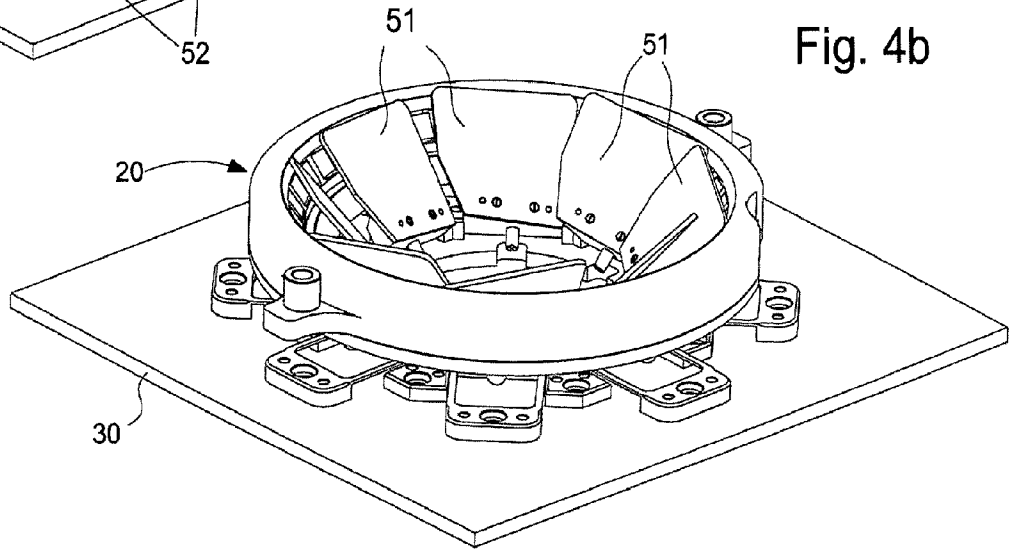

The chronometer according to the invention is wherein the support also includes a cradle 20 movable in translation between a rest position (FIG. 1), wherein the watch is free to move on the gimbal suspension, and a holding position (FIGS. 2*a*, 3), wherein the watch is resting on the cradle. Also in the example represented, the cradle has an intermediate position between the rest position and the holding position, an intermediate position wherein the magnetic means of the cradle are adapted to cooperate with the associated magnetic means of the watch to orient the watch in the cradle. The cradle is movable in translation here in a direction substantially perpendicular to the support.

To ensure the mobility of the cradle, the support includes, in the example represented:

- two holding arbors 31 positioned on either side of the cradle, on which arbors the cradle is slidably mounted by means of securing lugs 31*a* pierced with a hole whose diameter is adjusted to the diameter of holding arbors 31, and
- a scissor lift mechanism 32 (FIG. 5) for sliding the cradle along the holding arbor between the holding position and the rest position; the lift mechanism is thus set in motion manually by a user via a lever 33.

More precisely, in the example represented, the lift mechanism includes lever 33 and two pairs of connecting rods 34, 35 (cf. FIG. 1, 2*a*, 2*c* in particular) associated in a scissor arrangement and each pair of connecting rods being coupled to a holding arbor 31 as described hereinafter. One pair of connecting rods includes two connecting rods 34, 35 formed as follows. One connecting rod 34 includes a foot articulated by a pivot link to support 30 and a free end of connecting rod 34 is mechanically articulated to a securing lug 31*a* of the cradle. It will also be noted that connecting rod 34 includes an elastic strip 34*b* which allows stator lugs 31*a* to be clamped and ensures that the case is properly locked. One connecting rod 35 includes a foot articulated by a pivot link to support 30 and a free end of connecting rod 35 has an oblong aperture 36 extending along a longitudinal axis of connecting rod 35. The two connecting rods 34, 35 are linked to each other by a pivot connection having a pin 35*a* passing between the two ends of connecting rod 34 and between the foot and oblong aperture 36 of connecting rod 35 to achieve a scissor effect. The free ends of the two connecting rods 35 are rigidly connected to each other so that the motion of one of connecting rods 35 mechanically causes an identical motion of the other connecting rod 35. Lever 33 has two sides with a substantially L or "1" shape; a free end of a large side of the lever forms a handle 37; a free end of a small side 38 of the lever is slidably mounted inside oblong aperture 36 of connecting rod 35; two notches 36*a*, 36*b* in the oblong aperture make it possible to immobilise the free end of the small side of the lever in predefined positions; finally an intersection between the small side and the large side of lever 33 is articulated to support 30 by a pivot link. At rest, a pair of connecting rods 34, 35 forms closed scissors, the free end of small side 38 of the lever being positioned inside the oblong aperture on the side of scissor arbor 35*a*. Pulling/rotating lever handle 37 causes a displacement of the free end of small side 38 of the lever inside oblong aperture 36 towards the free end of connecting rod 35, a displacement which in turn causes an elevation of scissor arbor 35*a* and indirectly an elevation of the free end of connecting rod 34 and of cradle securing lug 31*a* along holding arbor 31. Pulling/rotating lever 33 thus causes a movement of translation of cradle 20 along the holding arbors.

Cradle 20 includes magnetic means 22 capable of cooperating with the associated magnetic means 14 of the watch to immobilise the watch in the cradle when the cradle is in the holding position. In the example represented, the cradle has an annular shape and its magnetic means are distributed around an inner periphery of the cradle.

According to one embodiment (not represented) of a chronometer according to the invention, magnetic means 14 of the watch comprise a plurality of magnetic devices distributed around the periphery of watch case 11, preferably inside the sealed case, in a plane substantially parallel to the plane of the watch crystal. The magnetic coupling between the magnetic means of the cradle and the magnetic means of the watch allow the watch to be oriented relative to the cradle to balance the weight of the watch when it is resting on the cradle.

According to the embodiment represented in the Figures, cradle 20 of support 30 can wind the barrel of the mechanical watch movement, in addition to immobilising the watch. To this end, watch 10 includes a mechanism comprising a winding rotor 13, and magnetic means 14 include a plurality of magnetic devices distributed around an external periphery of the rotor to form the magnetic means of the watch adapted to cooperate with the magnetic means of the cradle when the cradle is in the holding position or in the intermediate position. Inside the watch case, rotor 13 is associated with a toothed wheel 13*a* coupled in a known manner to the usual elements of the barrel-winding train.

Cradle 20 comprises an annular stator 21, in the form here of a toothed wheel (FIG. 3) and mounted to rotate relative to the support. The cradle stator includes a plurality of magnetic devices 22 distributed around an inner periphery of the stator to form the magnetic means of the cradle. The cradle also includes a casing 23 for protecting the external periphery of the stator (toothed wheel).

Finally, the support is completed by a winding pinion 40 adapted to mesh with stator 21 when the cradle is in the holding position, an aperture 24 being arranged in the casing to permit the mechanical connection between winding pinion 40 and stator 21. Winding pinion 40, which is arranged outside the case and is independent of the watch, can be driven in rotating manually by means of a key 41, a thumbwheel, a handle, . . . optionally supplemented by an electric assist device. The winding pinion and the cradle together form a winding means, movable between:

- a winding position (corresponding to the holding position of the cradle), wherein watch rotor 13 is magnetically coupled to the winding means, particularly to stator 21, the watch case then also being immobilised in the cradle, and
- a rest position (corresponding to the rest position of the cradle), wherein the watch rotor is free to rotate relative to the winding means.

"Magnetic devices" means, throughout the present description, permanent or non-permanent magnets, or magnetic parts capable of being magnetically coupled to magnets. For example, magnets can be used to make the magnetic devices 22 of the cradle and magnetic parts are used to make the magnetic devices 14 of the watch, or vice versa, or magnets are chosen for making the magnetic devices of the cradle and those of the watch. The choice of magnetic devices, their dimensions, magnetic force, number, and arrangement on the periphery of the cradle and on the periphery of the watch, are chosen as a function of the magnetic force required to immobilise the watch on the cradle and/or to drive the winding rotor 13 in rotation.

The cradle according to the embodiment represented in the Figures is used in the following manner. In the rest position (FIGS. 5*b*, 5*c*), the cradle rests on the support and is away from the watch; magnetic means 22 of the cradle and magnetic means 14 of the watch are away from each other, such that there is no magnetic coupling between them; the watch is thus free to move on the gimbal suspension.

When the user pulls handle 37 of lever 33, the cradle is lifted by mechanism 32 to the intermediate position (corresponding to notch 36*a*): cradle 20 is close to but not in contact with watch case 11 and magnetic means 22 of the cradle are magnetically coupled to magnetic means 14 of the watch (FIG. 5*d*). Thus, the magnetic devices 22 of the stator attract magnetic devices 14 of the watch until the axis of the cradle stator and the axis of the watch rotor are aligned, as the watch is movably mounted on the gimbal suspension. Brought into this position, the watch is held stationary and at equilibrium (in terms of weight) above the cradle by magnetic coupling.

When the user lowers lever 33 a little more, the cradle is lifted by mechanism 32 to the holding position (notch 36*b*): the cradle is in contact with watch case 11 so that the weight of the watch rests on the cradle, with strips 34*b* helping to press the stator against case 11. The magnetic coupling between magnetic devices 22 of the cradle and magnetic means 14 of the watch is then maximum. The watch is immobilised on the cradle so that the gimbal suspension is relieved of the weight of the watch. In this position too, winding pinion 40 meshes with stator 21 of the cradle. Thus, a rotation of key 41 drives in rotation the winding pinion, which in turn drives in rotation stator 21. In turn, the stator drives in rotation rotor 13 by magnetic coupling, which winds the watch barrel.

A chronometer according to the invention is advantageously completed by magnetic insulation means 50, movable between:

- an insulating position wherein, when the cradle is in the rest position, the insulation means form a magnetic screen between the magnetic means of the cradle and the magnetic means of the watch, and
- a retracted position wherein, when the cradle is in the holding position, the magnetic insulation means are inactive.

In the example represented in the Figures, the magnetic insulation means are formed of a plurality of blades 51 made of a magnetic shielding material; the blades are mounted side-by-side substantially in a circle inside the cradle; the blades are each mounted to pivot relative to an axis of pivoting substantially parallel to the support, between:

- an insulating position, corresponding to the rest position of cradle 20, wherein the blades are deployed to cover magnetic devices 22 of the cradle; any residual magnetic coupling between the stator and the rotor is thus neutralised, and
- a retracted position, corresponding to the holding position of the cradle, wherein the blades are moved away from the cradle and no longer form a magnetic screen between the magnetic devices of the rotor and those of the stator.

In practice here, the blades are resting on casing 23 of the cradle and are driven in rotation when cradle 20 is moved in translation. A counterweight 52 may be arranged on each blade to hold the blade against housing 23 during the motions of cradle 20.

In the example that has just been described, the mechanism is of the scissor type, to achieve the lifting and lowering motion of the stator but it is clear that in variants, other types of lifting mechanisms may be envisaged, by way of example, a simple knee lever mechanism or a mechanism with two connecting rods, or a knee lever press mechanism or a jack system for example with or without telescopic screw jacks Such mechanisms are described, in particular, at pages 144 and 145 of the work entitled "*Des Mécanismes Eléiomentaires*" edited by Decoopman, ISBN 97823650027, which are incorporated herein by reference.

NOMENCLATURE

10 Watch
11 case
12 suspension
13 rotor
14 magnetic devices
20 cradle
21 stator
22 magnetic devices
23 casing
24 aperture
30 support
31 holding arbor
31*a* securing lug
31 lift mechanism
33 lever
34, 35 pair of connecting rods forming scissors
35*a* mechanical link between the two connecting rods 35
36 oblong aperture
36*a*, 36*b* notches in the oblong aperture
37 handle of lever 33
38 small side of the lever
39 connection pin of two connecting rods 34, 35

40 winding pinion
41 key
50 magnetic insulation means
51 blade
52 counterweight

What is claimed is:

1. A marine chronometer, comprising:

a watch tiltably mounted on a support with a gimbal suspension, the marine chronometer support also comprises a cradle movable in translation between a rest position wherein the watch is free to move on the gimbal suspension, and a holding position wherein the watch is resting on the cradle, wherein the cradle comprises magnetic means capable of cooperating with associated magnetic means of the watch to immobilise the watch in the cradle when the cradle is in the holding position.

2. The chronometer according to claim 1, wherein the cradle is movable in translation in a direction substantially perpendicular to the support.

3. The chronometer according to claim 1, wherein the cradle has an intermediate position between the rest position and the holding position, an intermediate position wherein the magnetic means of the cradle are adapted to cooperate with the associated magnetic means of the watch to orient the watch in the cradle.

4. The chronometer according to claim 1, also comprising magnetic insulation means movable between:

an insulating position wherein, when the cradle is in the rest position, the insulation means form a magnetic screen between the magnetic means of the cradle and the magnetic means of the watch, and a retracted position wherein, when the cradle is in the holding position, the magnetic insulation means are inactive.

5. The chronometer according to claim 4, wherein the magnetic insulation means are driven in motion by the cradle.

6. The chronometer according to claim 1, wherein the cradle comprises an annular rotating stator comprising a plurality of magnetic devices distributed around an inner periphery of the stator to form the magnetic means of the cradle.

7. The chronometer according to claim 6, wherein the stator is a toothed wheel adapted to mesh with a winding pinion when the cradle is in the holding position.

8. The chronometer according to claim 7, wherein the watch comprises a mechanical timepiece mechanism driven by a barrel and a barrel-winding mechanism comprising a winding rotor in mesh with a barrel-winding train, and wherein the winding rotor comprises a plurality of magnetic devices distributed around an external periphery of the rotor to form the magnetic means of the watch adapted to cooperate with the magnetic means of the cradle when the cradle is in the holding position or in an intermediate position.

9. The chronometer according to claim 1, wherein the support comprises:

at least one holding arbor on which the cradle is slidably mounted, and a scissor-lift type mechanism for sliding the cradle along the holding arbor between the holding position and the rest position.

10. The chronometer according to claim 1, wherein the magnetic means of the cradle include magnets and the magnetic means of the watch include magnets.

11. A marine chronometer comprising:

a watch tiltably mounted on a support with a gimbal suspension, wherein the marine chronometer watch comprises a mechanical movement driven by a barrel and comprising a winding rotor in mesh with a barrel-winding train, and wherein the support comprises a winding means, movable between:

a winding position wherein the winding rotor of the watch is magnetically coupled to the winding means, and a rest position wherein the winding rotor of the watch is free to rotate with respect to the winding means.

12. The chronometer according to claim 11, wherein the winding means comprises an annular stator comprising a plurality of magnetic devices distributed around an inner periphery of the stator, the stator being movable between the winding position and the rest position, the stator being a toothed wheel adapted to mesh with a winding pinion when the stator is in the winding position.

13. The chronometer according to claim 12, wherein the winding pinion is disposed outside a case and is independent from the watch.

14. A marine chronometer comprising:

a watch tiltably mounted on a support with a gimbal suspension, the marine chronometer support also comprises a cradle movable in translation between a rest position wherein the watch is free to move on the gimbal suspension, and a holding position wherein the watch is resting on the cradle, wherein the support comprises:

at least one holding arbor on which the cradle is slidably mounted, and a scissor-lift type mechanism for sliding the cradle along the holding arbor between the holding position and the rest position.

15. The chronometer according to claim 14, wherein the cradle is movable in translation along the holding arbor in a direction substantially perpendicular to the support.

16. The chronometer according to claim 14, wherein the scissor-lift type mechanism includes a lever and two pairs of connecting rods.

17. The chronometer according to claim 16, wherein each pair of connecting rods includes a first connecting rod with a first end pivotally connected to the support and a second end connected to the holding arbor, and a second connecting rod with a first end pivotally connected to the support.

18. The chronometer according to claim 17, wherein the first connecting rod is pivotally connected to the second connecting rod.

19. The chronometer according to claim 17, wherein second ends of the second connecting rods are connected via a mechanical link.

20. The chronometer according to claim 17, wherein the lever is pivotally connected to the support and the second connecting rod such that rotation of the lever raises or lowers the scissor-lift type mechanism.

* * * * *